US009978491B2

(12) United States Patent
Ota et al.

(10) Patent No.: US 9,978,491 B2
(45) Date of Patent: May 22, 2018

(54) CHOKE COIL

(71) Applicant: FDK CORPORATION, Tokyo (JP)

(72) Inventors: Masaru Ota, Tokyo (JP); Mikio Kitaoka, Tokyo (JP); Yuko Kanazawa, Tokyo (JP)

(73) Assignee: FDK CORPORATION, Tokyo (JP)

( * ) Notice: Subject to any disclaimer, the term of this patent is extended or adjusted under 35 U.S.C. 154(b) by 209 days.

(21) Appl. No.: 14/380,019

(22) PCT Filed: Feb. 8, 2013

(86) PCT No.: PCT/JP2013/000693

§ 371 (c)(1),
(2) Date: Aug. 20, 2014

(87) PCT Pub. No.: WO2013/125169

PCT Pub. Date: Aug. 29, 2013

(65) Prior Publication Data

US 2015/0042433 A1 Feb. 12, 2015

(30) Foreign Application Priority Data

Feb. 21, 2012 (JP) ..... 2012-034874

(51) Int. Cl.
*H01F 21/00* (2006.01)
*H01F 17/06* (2006.01)
(Continued)

(52) U.S. Cl.
CPC ..... *H01F 3/14* (2013.01); *H01F 17/043* (2013.01); *H01F 2003/103* (2013.01); *H01F 2003/106* (2013.01)

(58) Field of Classification Search
USPC ..... 336/110, 178, 212, 221
See application file for complete search history.

(56) References Cited

U.S. PATENT DOCUMENTS 2,462,884 A * 3/1949 Miller, Jr. ..... 336/65
3,968,465 A * 7/1976 Fukui et al. ..... 336/110
(Continued)

FOREIGN PATENT DOCUMENTS

DE 10259117 A1 * 7/2004 ..... H01F 3/10
GB 2415833 A * 1/2006 ..... H01F 3/10
(Continued)

OTHER PUBLICATIONS

International Search Report dated May 14, 2013 in International (PCT) Application No. PCT/JP2013/000693.

*Primary Examiner* — Tsz Chan
(74) *Attorney, Agent, or Firm* — Wenderoth, Lind & Ponack, L.L.P.

(57) ABSTRACT

A choke coil including a coil (6) and a core (1) including a first core part (5) inserted into a central hole of the coil (6) and a plurality of second core parts (4) disposed along the outer periphery of the coil. The first core part (5) and the second core part (4) form a closed magnetic path. The second core parts (4) are shaped so that the total sum of the areas of cross sections thereof perpendicular to the axis of the coil is greater than the area of a cross section of the first core part (5). A gap part (G) is formed in the second core parts (4), and a ferrite magnet (7) that applies a magnetic bias is disposed in the gap part (G).

4 Claims, 11 Drawing Sheets

(51) Int. Cl.

| | |
|---|---|
| ***H01F 27/24*** | (2006.01) |
| ***H01F 17/04*** | (2006.01) |
| ***H01F 3/14*** | (2006.01) |
| *H01F 3/10* | (2006.01) |

(56) References Cited

U.S. PATENT DOCUMENTS

| | | | | |
|---|---|---|---|---|
| 4,035,745 | A * | 7/1977 | Doetsch et al. | 331/114 |
| 4,352,080 | A * | 9/1982 | Mitsui | H01F 17/04 336/233 |
| 4,760,366 | A * | 7/1988 | Mitsui | 336/233 |
| 5,471,378 | A * | 11/1995 | King | 363/46 |
| 5,926,083 | A * | 7/1999 | Asaoka | 336/110 |
| 2002/0050905 | A1* | 5/2002 | Okita | H01F 29/146 336/110 |
| 2008/0303619 | A1* | 12/2008 | Viitanen | H01F 3/12 336/110 |

FOREIGN PATENT DOCUMENTS

| | | |
|---|---|---|
| JP | 8-45749 | 2/1996 |
| JP | 2002-83722 | 3/2002 |
| JP | 2005-45108 | 2/2005 |
| JP | 2005-159027 | 6/2005 |
| JP | 2005159027 A * | 6/2005 |

* cited by examiner

CHOKE COIL

BACKGROUND OF THE INVENTION

1. Technical Field

The present invention relates to a choke coil with direct current superposition characteristics improved by disposing a magnet that applies a magnetic bias in a gap part in a core that forms a closed magnetic path.

2. Description of the Related Art

Many choke coils incorporated in AV equipment, OA or FA equipment, on-vehicle power supply circuits or the like are improved in direct current superposition characteristics by disposing, in a gap part in a core, a magnet that applies as a magnetic bias a magnetic flux in the opposite direction to the magnetic flux in the core.

Recent power supply circuits are reduced in voltage in order to reduce power consumption, and have more capabilities and therefore consume more electric power, so that choke coils incorporated in those power supply circuits are required to work under high current conditions. However, with the choke coils configured as described above, the magnetic flux in the core acts in the opposite direction to the magnetic flux of the magnet, so that the magnet can be demagnetized and reduced in magnetic force as the current increases and the magnetic flux of the core increases.

A conventional choke coil through which a current of several amperes (A) or higher flows is provided with a magnet disposed in the core gap that is made of a rare earth metal having a high coercive force (such as a neodymium magnet or a samarium-cobalt magnet), for example. In the inductor having a capacity of approximately 1 kw described in Japanese Patent Laid-Open Application No. 2002-83722, a samarium-iron-nitrogen (SmFeN) bonded magnet, which is of the same kind as the magnets described above, is used.

SUMMARY OF THE INVENTION

1. Technical Problem

However, such a rare earth metal-based magnet has drawbacks that it is expensive and therefore leads to an increase of the cost of the product and that it is hard to machine and therefore is difficult to shape so as to achieve optimal magnetic characteristics.

In addition, since the magnet is made of a metal material, an eddy current tends to occur because of the electromagnetic induction effect when the magnetic field from the core abruptly changes. The eddy current generates Joule heat, which can heat the magnet to increase the temperature of the choke coil and prevent achievement of desired magnetic characteristics or can adversely affect peripheral equipment.

In order to solve the problems described above, the inventors have made investigations and found that although the magnet disposed in the gap part in the core in the central hole of the coil noticeably exhibits an adverse effect of demagnetization due to an increase of the magnetic flux of the core caused by an increase of the current, if a plurality of cores are disposed along the outer periphery of that core, the magnetic flux in each of the plurality of outer cores is a divisional magnetic flux, and a magnetic field leakage occurs in the separate cores, so that a ferrite magnet having a low coercive force, which has been considered inappropriate as a magnet that is incorporated in the choke coil of this type to apply a magnetic bias, does not exhibit a significant adverse effect of demagnetization and can achieve desired direct current superposition characteristics.

The present invention has been made based on the findings described above, and an object of the present invention is to provide a choke coil that can apply an optimal magnetic bias while suppressing the effect of demagnetization even when the current increases and can be reduced in size, weight and cost.

2. Solution to the Problem

To attain the object described above, the present invention is directed to a choke coil including a coil and a core including a first core part inserted into a central hole of the coil and a plurality of second core parts disposed along an outer periphery of the coil, the first core part and the second core part forming a closed magnetic path. The second core parts are shaped so that the total sum of areas of cross sections thereof perpendicular to an axis of the coil is greater than the area of a cross section of the first core part, a gap part is formed in the second core parts, and a ferrite magnet that applies a magnetic bias is disposed in the gap part.

The ferrite magnet can be formed by a plurality of separate ferrite magnets divided in a plane perpendicular to a direction of a magnetic flux contained in the second core parts.

Also, a flat plate member made of a resin or ferrite having a plurality of holes penetrating from a top surface to a bottom surface thereof is provided in the gap part, and the separate ferrite magnets are inserted into the holes.

Further, the choke coil is to be incorporated in a power supply circuit having a capacity of 1 kw to 10 kw.

3. Advantageous Effects of the Invention

In the present invention, the plurality of second core parts disposed along the outer periphery of the coil are shaped so that the total sum of the areas of the cross sections thereof perpendicular to the axis of the coil is greater than the area of the cross section of the first core part disposed in the central hole of the coil, and the ferrite magnet that applies a magnetic bias is disposed in the gap part formed in the second core parts.

Therefore, even if the current increases and therefore the magnetic flux of the core increases, the magnetic flux contained in each second core part is a divisional magnetic flux and has a reduced density, so that the increase of the amount of the magnetic flux of each second core part that acts on the ferrite magnet is reduced. Therefore, even the ferrite magnet that does not have a high coercive force suffices and does not result in a deterioration of characteristics due to demagnetization. Thus, even if the choke coil is incorporated in a power supply current having a capacity of 1 to 10 kw and a high current of 10 to 100 A flows through the choke coil, an optimal magnetic bias can be applied.

In addition, the ferrite magnet is extremely low in loss of an eddy current, which causes heat generation, so that there is no possibility that the temperature of the choke coil increases and problems arise such as deterioration of the magnetic characteristics. Therefore, the thickness of the ferrite magnet can be reduced to further reduce the size or weight of the choke coil. Furthermore, the ferrite magnet can be easily formed by powder molding to have a shape or width suitable for applying an optimal magnetic bias and is inexpensive compared with the rare earth-based magnet and therefore leads to a decrease of the cost.

Also, the plurality of separate ferrite magnets each has an area equal to a division of the area required to apply a desired magnetic bias. Therefore, when the magnetic field from the second core part abruptly changes, generation of an eddy current in each of the separate ferrite magnets is further reduced or suppressed compared with the case where a single magnet is used. Therefore, the total amount of heat generation of the separate ferrite magnets can be reduced, and a disadvantageous increase of the temperature of the choke coil can be prevented with reliability.

In placement of the plurality of separate ferrite magnets, the separate ferrite magnets are preferably placed so as to evenly distribute the magnetic force as a whole. In actual, however, since each separate ferrite magnet has a specific magnetic force, it is difficult to place the plurality of separate ferrite magnets precisely at appropriate distances in the plane because of the magnetic attractive forces therebetween.

In this regard, the ferrite magnets can be easily positioned at regular intervals, since the flat plate member made of a resin or ferrite having a plurality of holes formed therein is placed in the gap part, and the separate ferrite magnets are inserted into the holes of the flat plate member.

DETAILED DESCRIPTION OF THE INVENTION

First Embodiment

Figure 1A:
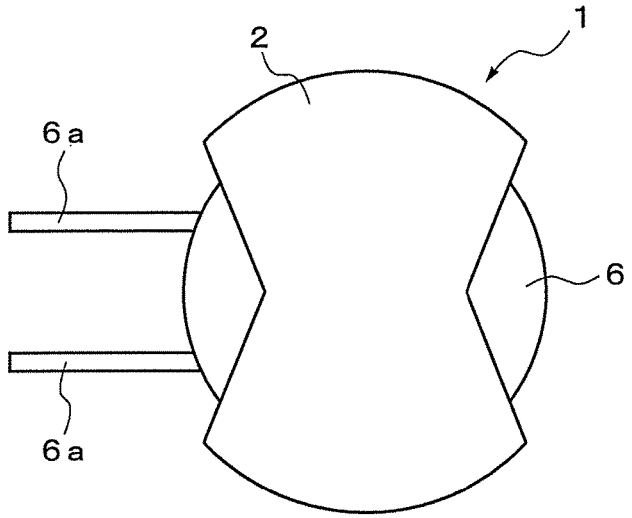
FIG. 1A is a plan view showing a choke coil according to a first embodiment of the present invention.
Figure 1B:
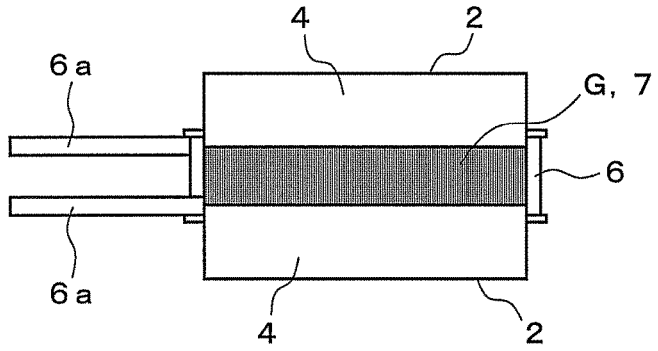
FIG. 1B is a front view of the choke coil shown in FIG. 1A.
Figure 1C:
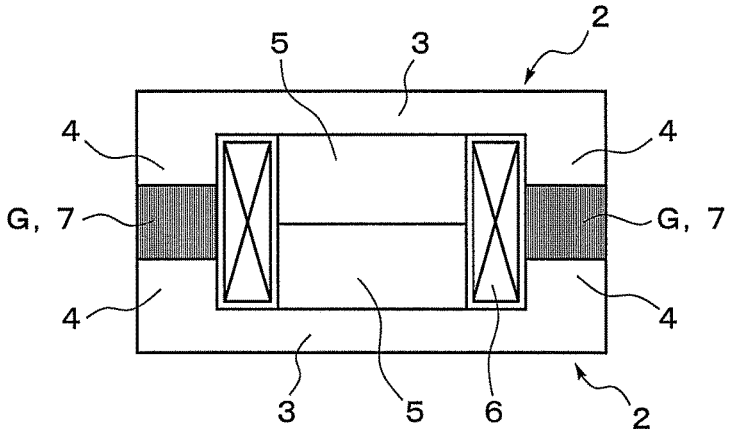
FIG. 1C is a vertical cross sectional view of the choke coil shown in FIG. 1A.

FIGS. 1 to 4 are diagrams showing a choke coil according to a first embodiment of the present invention to be incorporated in a power supply circuit having a capacity of 1 to 10 kw and variations thereof. In these drawings, reference numeral 1 denotes a ferrite core assembly.

The ferrite core assembly 1 is formed by a pair of butterfly-shaped cores 2 and 2, each of which is E-shaped in front view, and has a double rectangular shape (theta shape) in front view as a whole.

Figure 2A:
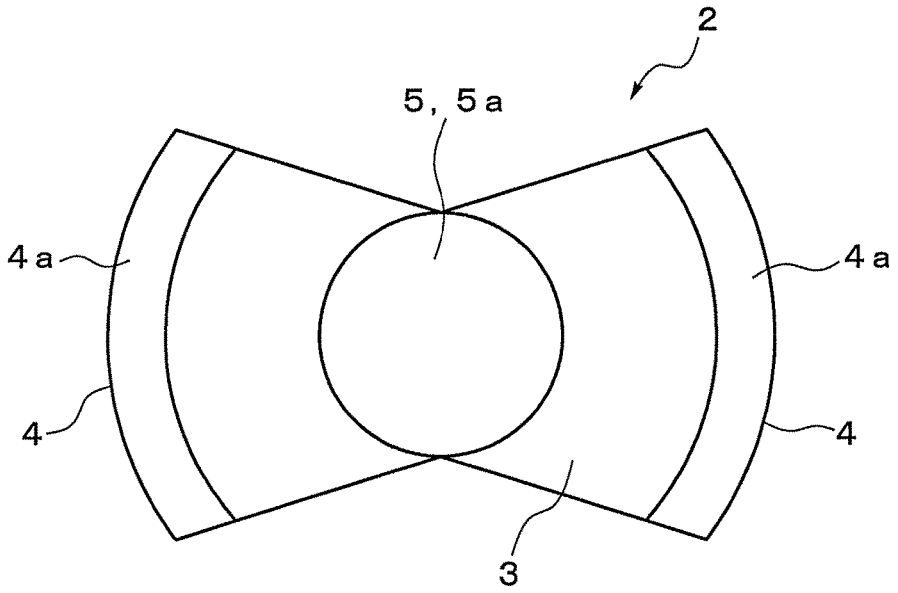
FIG. 2A is a plan view showing a shape of a core of the choke coil.
Figure 2B:
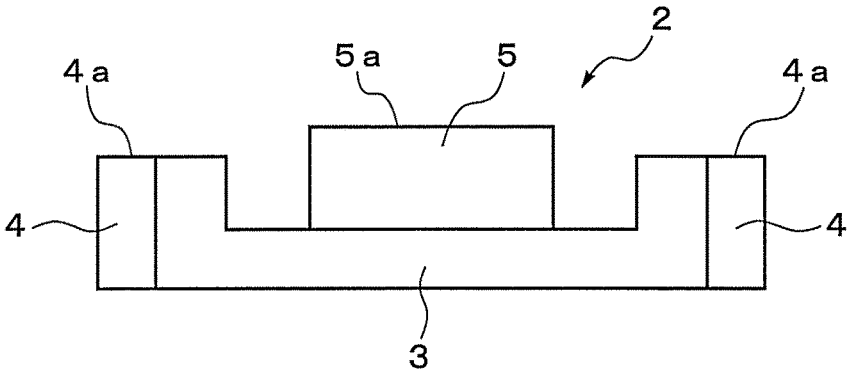
FIG. 2B is a front view showing the shape of the core.

As shown in FIGS. 2A and 2B, each butterfly-shaped core 2 includes a flat plate part 3, outer legs (second core parts) 4 having a substantially plate-like shape standing at both longitudinal ends of the flat plate part 3, and a cylindrical central leg (first core part) 5 standing at the center between the outer legs 4, which are formed integrally. The height of the outer legs 4 is lower than the height of the central leg 5. The flat plate part 3 is formed by a pair of substantially sector-shaped portions extending from the central leg 5 to the outer legs 4 on the both ends, each of which has a gradually increasing width as it comes closer to the outer leg 4. Inner and outer peripheral surfaces of the outer legs 4 on the both ends have the shape of an arc about the axis of the central leg 5.

The butterfly-shaped core 2 is shaped so that the sum of the areas of tip end surfaces 4*a* of the two outer legs 4 is greater than the area of a cross section 5*a* of the central leg 5 perpendicular to the axis of the central leg 5.

The pair of butterfly-shaped cores 2 is assembled so that the outer legs 4 surround a coil 6, which has a substantially cylindrical shape, the flat plate parts 3 are disposed on end surfaces of the coil 6, and the central legs 5 are inserted into a central hole of the coil 6 so as to abut against each other at tip end surfaces 5*a* thereof. In the drawings, reference numeral 6*a* denotes a lead of the coil 6 drawn from between the outer legs 4.

In this way, the central legs 5 of the pair of butterfly-shaped coils 2 inserted into the central hole of the coil 6, the outer legs 4 surrounding the outer periphery of the coil 6 and the flat plate parts 3 form the ferrite core assembly 1 having a double rectangular shape that forms a closed magnetic path, and a gap part G is formed between the opposed outer legs 4.

A ferrite magnet 7 that applies as a magnetic bias a magnetic flux in the opposite direction to the magnetic flux in the outer legs 4 is disposed in the gap part G. The ferrite magnet 7 has an arc-shaped plate shape that agrees with the shape of the tip end surface 4*a* of the outer leg 4 and has the same thickness as the gap part G.

Figure 3A:
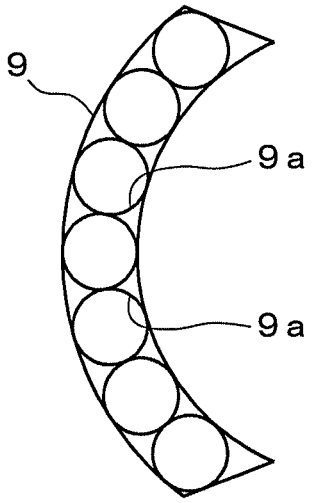
FIG. 3 includes diagrams showing a shape of a flat plate member of the choke coil and usage thereof according to a modification.
Figure 3B:
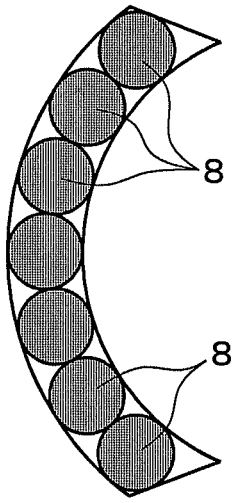
Figure 3C:
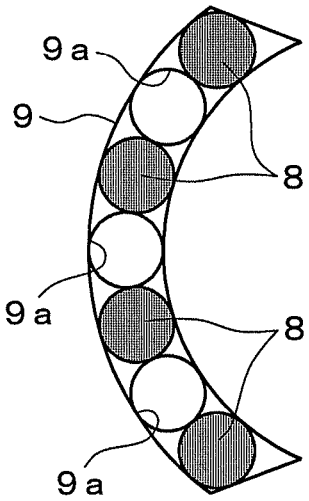

FIGS. 3A to 3C show a modification of the first embodiment configured as described above. In the following description, the same components as those in the first embodiment will be denoted by the same reference numerals, and descriptions thereof will be simplified.

In the choke coil according to the modification, the ferrite magnet 7 in the gap part G between the tip end surfaces 4*a* of the outer legs 4 described above is replaced with a flat plate member 9 incorporating a plurality of separate ferrite magnets 8.

As shown in FIG. 3A, the flat plate member 9 is made of a resin or ferrite and has an arc-shaped plate shape that agrees with the shape of the tip end surface 4*a* of the outer leg 4 and has the same thickness as the gap part G, and a plurality of (seven in the drawing) circular holes 9*a* penetrating from the top surface to the bottom surface are formed in the flat plate member 9 along the arc thereof. As shown in FIG. 3B, separate circular ferrite magnets 8 are inserted into the holes 8*a*.

The separate ferrite magnets 8 are shaped so that each ferrite magnet 8 has an area equal to a seventh of the area required to apply a desired magnetic bias. The ferrite magnets 8 are disposed adjacent to each other in a plane perpendicular to the direction of the magnetic fluxes contained in the outer legs 4 of the ferrite core assembly 1.

Figure 4A:
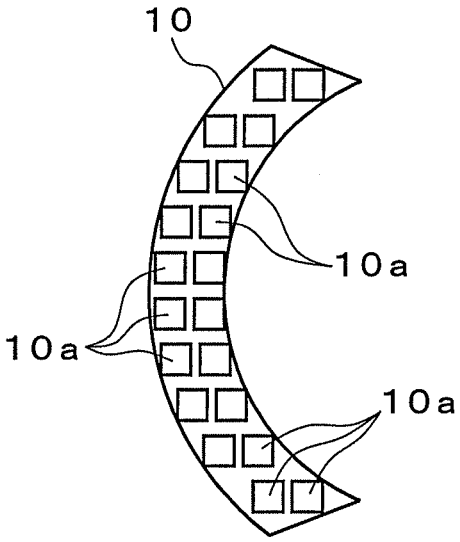
FIG. 4 includes diagrams showing another shape of the flat plate member of the choke coil and usage thereof according to the modification.
Figure 4B:
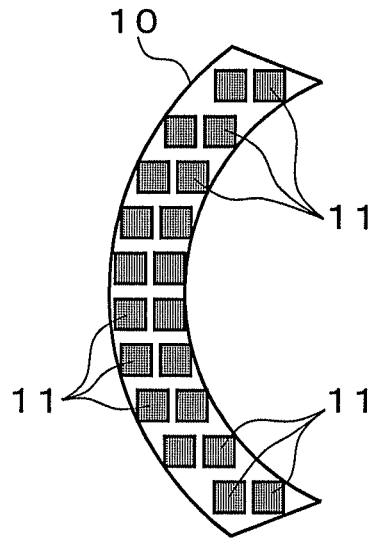

FIG. 4A shows a modification of the flat plate member. A flat plate member 10 shown in this drawing is also made of a resin or ferrite and has the same outer dimensions as the flat plate member 9 having the arc-shaped plate shape. However, in the flat plate member 10, a plurality of square holes 10*a* (two rows of ten, a total of 20, square holes in the drawing) penetrating from the top surface to the bottom surface are formed. As shown in FIG. 4B, separate ferrite magnets 11 having a square shape are inserted into the holes 10*a*.

Second Embodiment

Figure 5A:
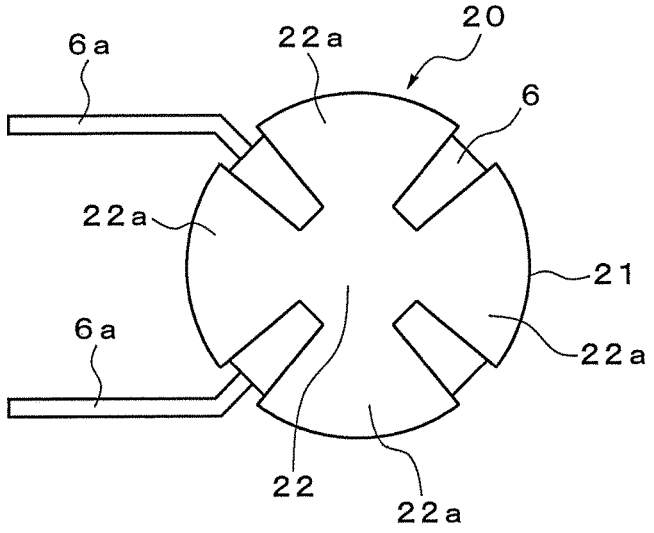
FIG. 5A is a plan view showing a choke coil according to a second embodiment of the present invention.
Figure 5B:
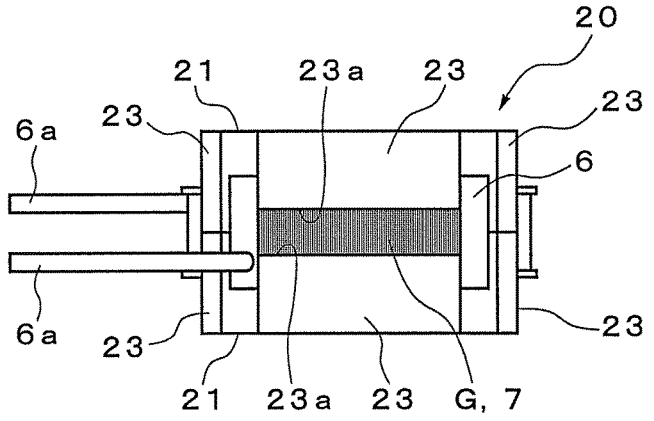
FIG. 5B is a front view of the choke coil shown in FIG. 5A.
Figure 5C:
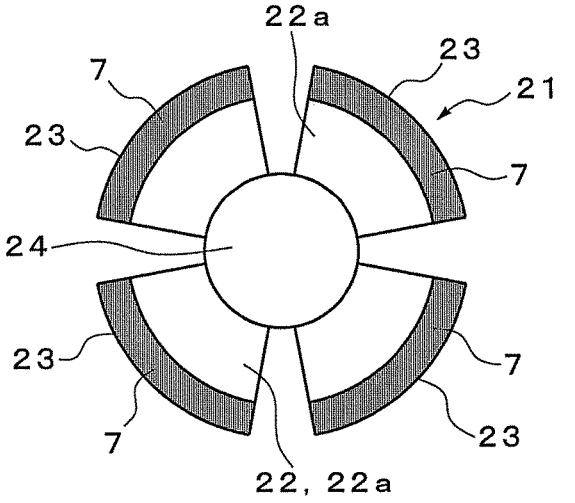
FIG. 5C is a vertical cross sectional view of the choke coil shown in FIG. 5A.

FIGS. 5A to 5C show a choke coil according to a second embodiment of the present invention that is also to be incorporated in a power supply circuit having a capacity of 1 to 10 kw.

In the choke coil, a ferrite core assembly 20 is formed by a pair of butterfly-shaped cores 21 and 21.

Each butterfly-shaped core 21 has a flat plate part 22 disposed on the end surface of the coil 6, and the flat plate part 22 has a substantially circular shape as a whole and has four sector-shaped outer peripheral parts 22*a* separated by four grooves extending from the outer circumference toward the center at regular circumferential intervals. Outer legs (second core parts) 23 having a substantially plate-like shape standing at the outer edges of the outer peripheral parts 22*a* are formed integrally with the outer peripheral parts 22*a*, and a cylindrical central leg (first core part) 24 standing at the center of the flat plate part 22 is formed integrally with the flat plate part 22. Note that the inner and outer peripheral surfaces of the four outer legs 23 also have the shape of an arc about the axis of the central leg 24.

In the ferrite core assembly 20, the height of the outer legs 23 is also lower than the height of the central leg 24. The butterfly-shaped core 21 is also shaped so that the sum of the areas of tip end surfaces 23*a* of the four outer legs 23 is greater than the area of the cross section of the central leg 24 perpendicular to the axis of the central leg 24. The pair of butterfly-shaped cores 21 is assembled so that the outer legs 23 surround the outer periphery of the coil 6, which has a substantially cylindrical shape, the flat plate parts 22 are disposed on the end surfaces of the coil 6, and the central legs 24 are inserted into the central hole of the coil 6 so as to abut against each other at tip end surfaces thereof.

In this way, the central legs 24 of the pair of butterfly-shaped cores 21 inserted into the central hole of the coil 6, the outer legs 23 surrounding the outer periphery of the coil 6 and the flat plate parts 22 form the ferrite core assembly 20 that forms a closed magnetic path, and the gap part G is formed between the surfaces of the four pairs of opposed outer legs 23.

Ferrite magnets 7 that apply a magnetic bias are disposed in the four gap parts G. Each ferrite magnet 7 has a substantially quarter arc-shaped plate shape that agrees with the shape of tip end surface 23*a* of the outer leg 23 and has the same thickness as the gap part G.

In the choke coils according to the first and second embodiments configured as described above, the two outer legs 4 or four outer legs 23 disposed to surround the outer periphery of the coil 6 are formed so that the sum of the areas of the tip end surfaces 4*a* or 23*a* is greater than the area of the cross section of the central leg 5 or 24 disposed at the center of the coil 6, and the ferrite magnets 7, 8 or 11 are disposed in the gap parts G formed between the opposed outer legs 4 or 23.

Even if the current increases and therefore the magnetic fluxes in the ferrite core assembly 1 or 20 increase, the magnetic fluxes contained between the opposed outer legs 4 or 23 are a half or a fourth of the whole of the magnetic fluxes and have a reduced density, so that the increase of the amount of the magnetic fluxes of each outer leg 4 or 23 that act on the ferrite magnet 7 is reduced. Therefore, even the ferrite magnet(s) 7, 8 or 11 that does not have a high coercive force suffices and does not result in a deterioration of characteristics due to demagnetization. Thus, even under high current conditions, such as in the case where the choke coil is incorporated in a power supply circuit having a capacity of 1 to 10 kw, an optimal magnetic bias can be applied.

In addition, the ferrite magnet(s) 7, 8 or 11 is extremely low in loss of an eddy current, which causes heat generation, so that there is no possibility that the temperature of the choke coil increases and problems arise such as deterioration of the magnetic characteristics. Therefore, the thickness of the ferrite magnet(s) 7, 8 or 11 can be reduced to further reduce the size or weight of the choke coil.

Furthermore, by powder molding, the ferrite magnet(s) 7, 8 or 11 can be easily formed at lower cost to have a shape or width suitable for applying an optimal magnetic bias.

With the choke coil according to the modifications of the first embodiment shown in FIG. 3 (3A to 3C) and (4A to 4C), separate ferrite magnets 8 or 11 each having an area equal to a seventh or a twentieth of the area required to apply a desired magnetic bias are disposed in the gap part G formed between the outer legs 4 of each pair of butterfly-shaped cores 2. Therefore, when the magnetic field from the outer legs 4 of the ferrite core assembly 1 abruptly changes, generation of an eddy current in each of the separate ferrite magnets 8 or 11 is further reduced or suppressed compared with the case where a single magnet is used.

Therefore, the total amount of heat generation of the ferrite magnets 8 or 11 can be reduced, a disadvantageous increase of the temperature of the choke coil can be prevented, and a loss due to the eddy current can be suppressed. In addition, the ferrite core assembly 1 formed by the butterfly-shaped cores 2 disposed to face each other has a low core loss and excellent direct current superposition characteristics. Therefore, in combination with the ferrite magnet(s) 7, 8 or 11 that applies a magnetic bias described above, the ferrite core assembly 1 can provide a choke coil that is smaller, lighter and more economic than conventional choke coils.

In addition, the ferrite magnets 8 or 11 can be easily positioned at regular intervals since the flat plate member 9 or 10 made of a resin or ferrite having seven holes 9*a* or twenty holes 10*a* formed therein is placed in the gap part G, and the separate ferrite magnets 8 or 11 are inserted into the holes 9*a* or 10*a* of the flat plate member 9 or 10.

In addition, placement of the ferrite magnet 8 or 11 can be completed simply by inserting the flat plate member 9 or 10 with the ferrite magnets 8 or 11 inserted in the holes 9*a* or 10*a* into the gap part G between the outer legs 4, so that the number of manufacturing steps can be reduced.

Figure 4C:
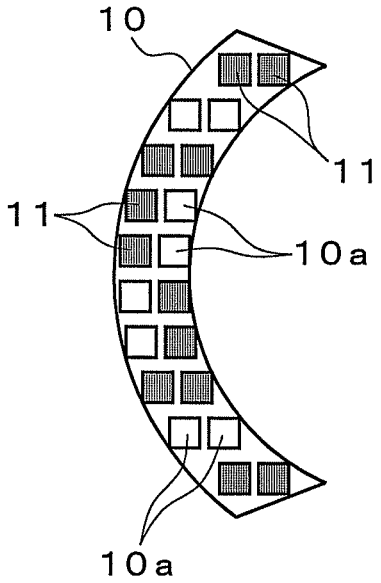

In addition, if the number of holes 9*a* or 11A formed in the flat plate member 9 or 10 is larger than the number of required separate ferrite magnets 8 or 11 as shown in FIGS. 3C and 4C, the positions or number of separate ferrite magnets 8 or 11 can be changed to arbitrarily adjust the magnetic bias as required.

With regard to the second embodiment described above, only the case has been described where one ferrite magnet 7 is disposed in each of the gap parts G between the opposed surfaces of the four pairs of outer legs 23. However, the present invention is not limited to the arrangement. As an alternative to the ferrite magnet 7 described above, as in the modification of the first embodiment, the flat plate member 9 or 10 with a plurality of ferrite magnets 8 or 11 may be disposed between the outer legs 23.

The material of the flat plate member 9 or 10 can be a resin or ferrite. However, the flat plate member 9 or 10 made of ferrite can have an improved thermal dissipation due to thermal conduction and improved magnetic bias characteristics.

EXAMPLES

First Example

Figure 6A:
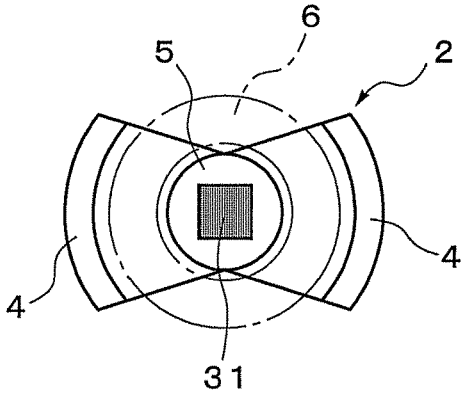
FIG. 6A is a plan view showing a first example of the present invention.
Figure 6B:
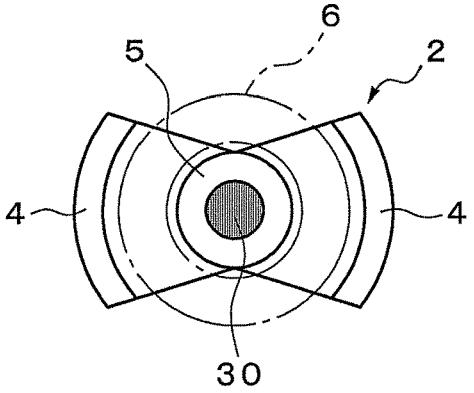
FIG. 6B is a plan view showing a first comparative example.
Figure 6C:
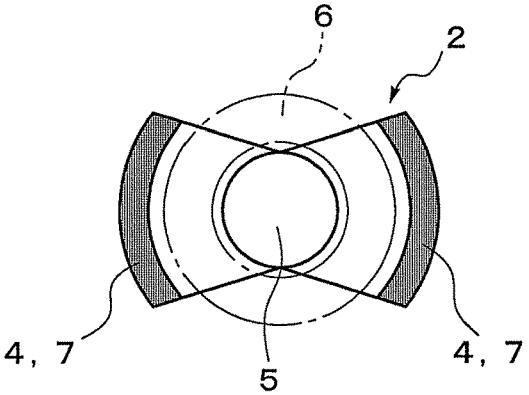
FIG. 6C is a plan view showing a second comparative example.

First, a comparative experiment for magnet heat generation was conducted for the choke coil including the butterfly-shaped cores 2 according to the first embodiment, using a choke coil according to a first example of the present invention in which ferrite magnets 7 were disposed in the gap parts G between the opposed outer legs 4 as shown in FIG. 6A and choke coils according to first and second comparative examples in which one circular samarium-cobalt magnet 30 or one square samarium-cobalt magnet 31 was disposed in the gap part formed between the opposed central legs 5 as shown in FIGS. 6B and 6C.

Table 1 shows results of the experiment conducted using the choke coils shown in FIGS. 6A to 6C.

As shown in Table 1, while the amount of heat generated by the ferrite magnets 7 in the first example was 0.0 W, the amounts of heat generated by the circular samarium-cobalt magnet 30 and the square samarium-cobalt magnet 31 disposed in the gap part G between the opposed central legs 5 in the first and second comparative examples were 12 W and 17 W, respectively. This result proves that placing the ferrite magnet 7 between the opposed outer legs 4 has an effect of reducing the amount of heat generation.

TABLE 1

| | MAGNETS OF THE SAME SHAPE BETWEEN OUTER LEGS (PRESENT INVENTION) | MAGNET BETWEEN CENTRAL LEGS (FIRST COMPARATIVE EXAMPLE) | MAGNET BETWEEN CENTRAL LEGS (SECOND COMPARATIVE EXAMPLE) |
|---|---|---|---|
| AMOUNT OF HEAT GENERATED BY MAGNET | 0.0 [W] | 12 [W] | 17 [W] |

Second Example

Figure 7A:
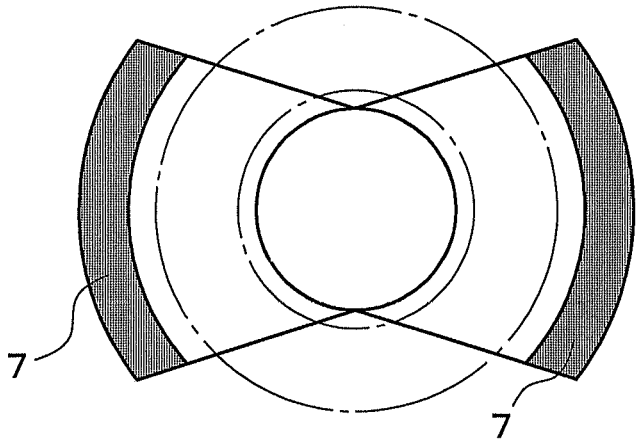
FIG. 7A is a plan view showing a shape of a choke coil according to a second example of the present invention.
Figure 7B:
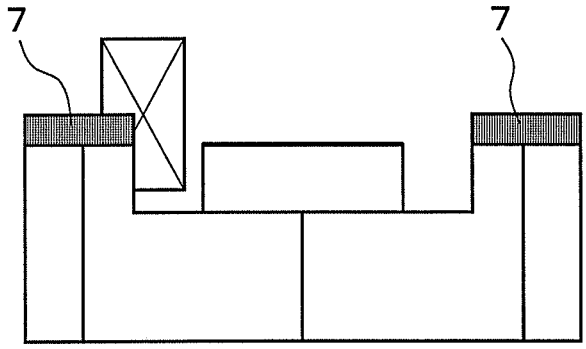
FIG. 7B is a side view of the choke coil.
Figure 7C:
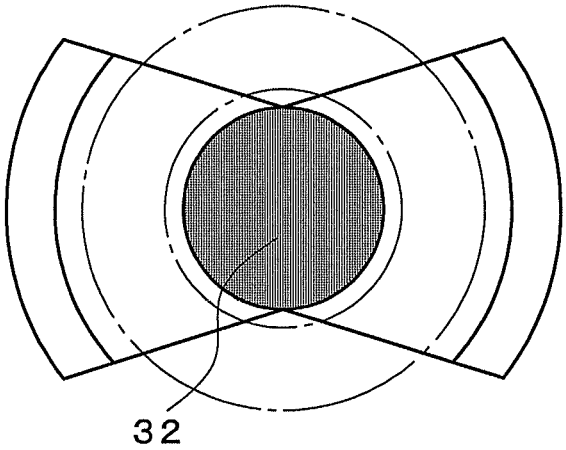
FIG. 7C is a plan view of a choke coil according to a comparative example.
Figure 7D:
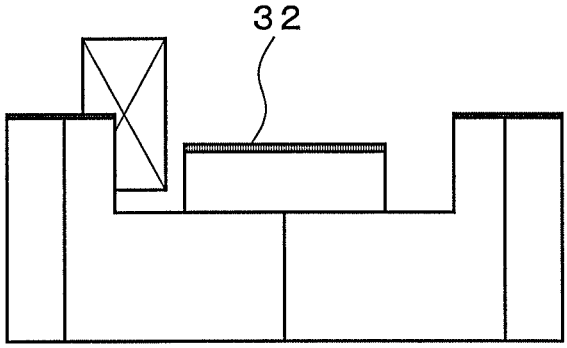
FIG. 7D is a side view of the choke coil.

Next, between a choke coil including butterfly-shaped cores according to a second example of the present invention in which ferrite magnets 7 were disposed between the opposed outer legs as shown in FIGS. 7A and 7B and a choke coil including the butterfly-shaped cores according to a third comparative example in which a ferrite magnet 32 was disposed between the opposed central legs as shown in FIGS. 7C and 7D, differences in direct current superposition characteristics at temperatures of 25° C. and 100° C. were determined by analysis. Note that inductance was adjusted by adjusting the gap to achieve an equal number of turns.

Figure 8A:
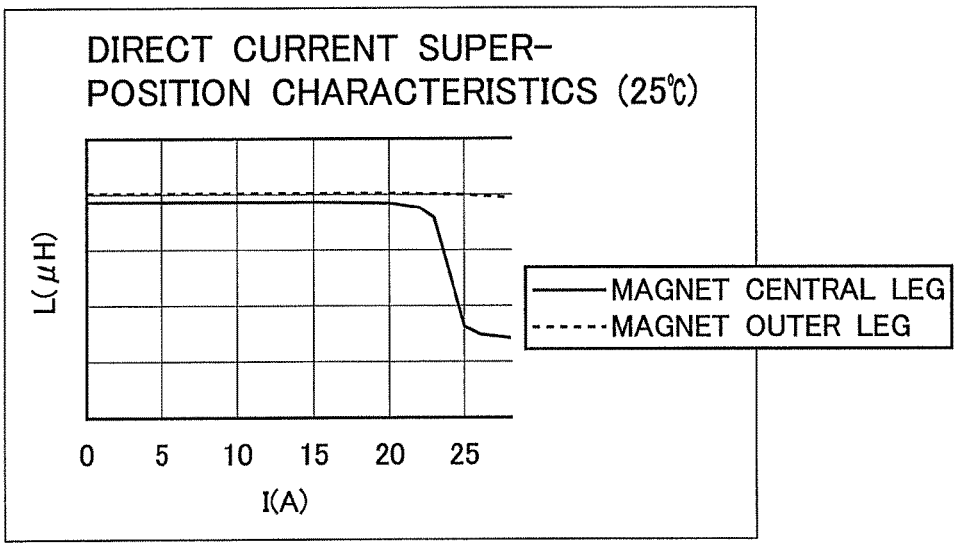
FIG. 8A is a graph showing a result of analysis of direct current superposition characteristics conducted for the choke coil according to the second example and the choke coil according to the comparative example.
Figure 8B:
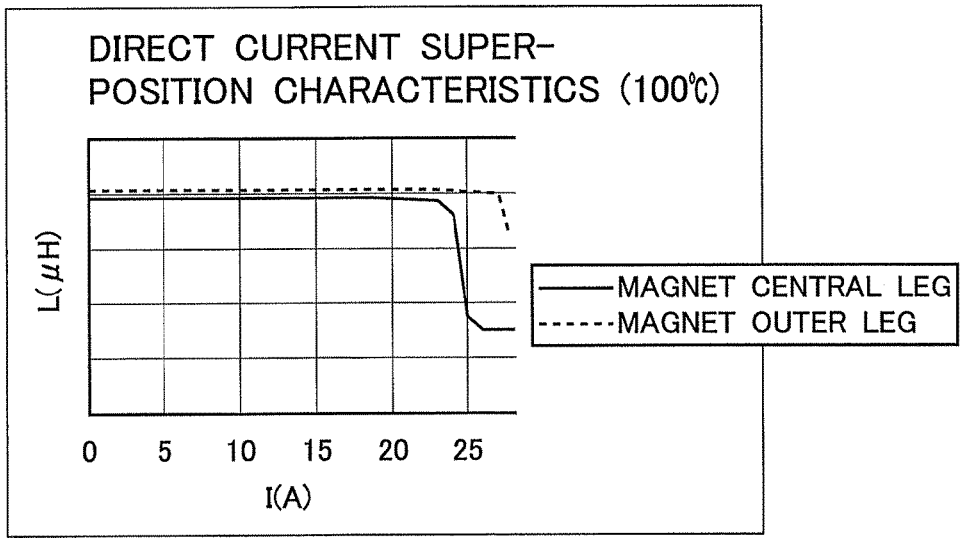
FIG. 8B is a graph showing a result of analysis of direct current superposition characteristics conducted for the choke coil according to the second example and the choke coil according to the comparative example.

FIGS. 8A and 8B show results of experiments. FIGS. 8A and 8B show graphs that indicate the result of analysis of the direct current superposition characteristics using the choke coil according to the second example and the choke coil according to the third comparative example.

As shown in FIG. 8A, in the experiment under the condition that the temperature was 25° C., while the choke coil according to the third comparative example in which the ferrite magnet 32 was disposed between the opposed central legs exhibited a significant inductance reduction after the current exceeded 20 A, the choke coil according to the second example in which the ferrite magnets 7 were disposed between the opposed outer legs did not exhibit an inductance reduction even after the current exceeded 25 A.

As shown in FIG. 8B, in the experiment for the direct current superposition characteristics under a more extreme condition that the temperature was 100° C., while the choke coil according to the third comparative example in which the ferrite magnet 32 was disposed between the opposed central legs exhibited a significant inductance reduction after the current exceeded 20 A, the choke coil according to the second example in which the ferrite magnets 7 were disposed between the opposed outer legs exhibited a slight inductance reduction only after the current exceeded 25 A.

Third Example

Figure 9A:
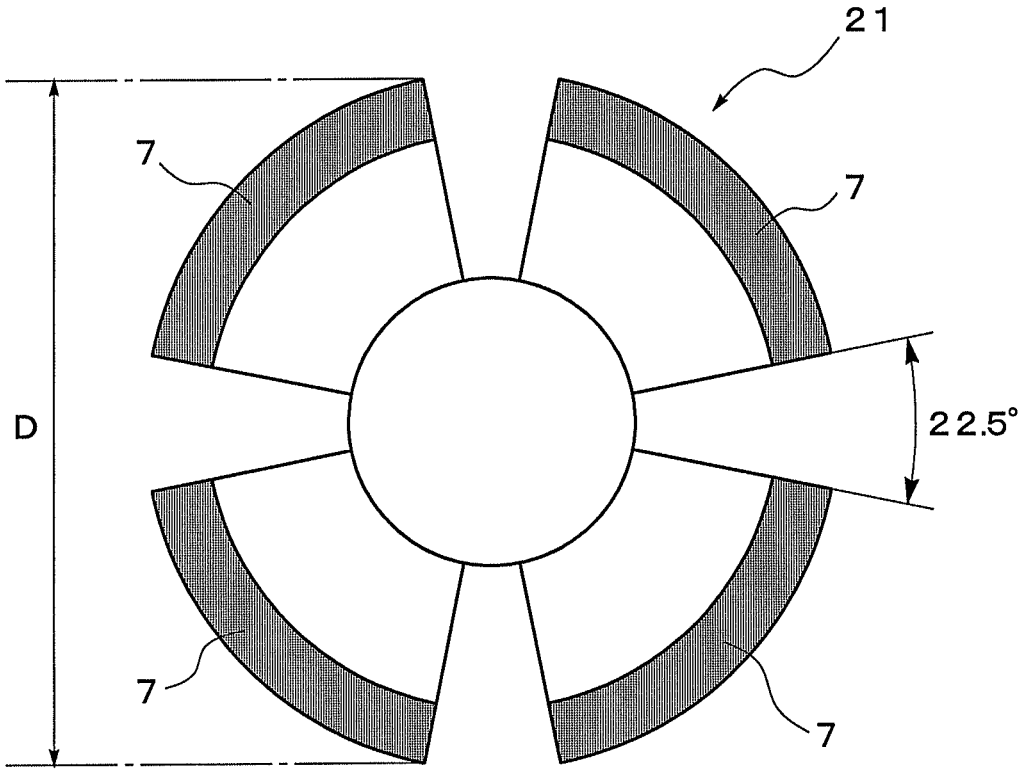
FIG. 9A is a plan view showing shapes of a butterfly-shaped core and ferrite magnets of a choke coil used in a third example, which are arranged according to the second embodiment.
Figure 9B:
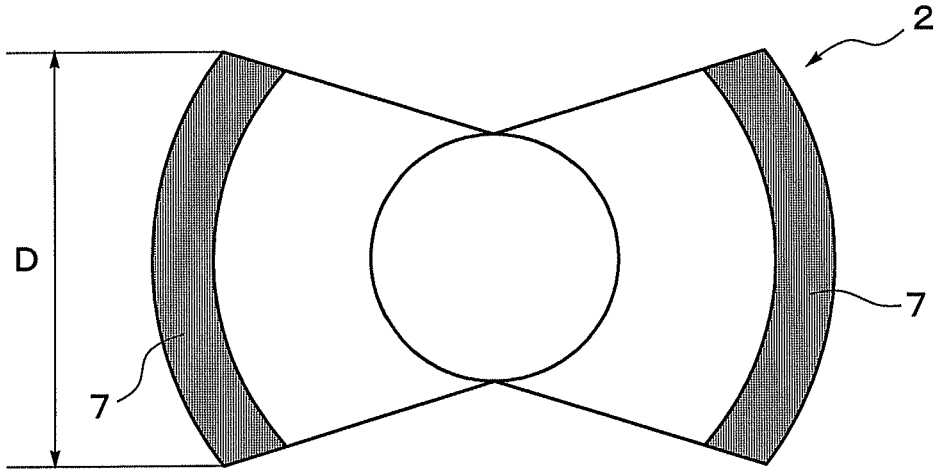
FIG. 9B is a plan view showing shapes of a butterfly-shaped core and ferrite magnets of a choke coil used in the third example, which are arranged according to the first embodiment.

Next, in order to verify the effect of the ratio between the total sum of the areas of the cross sections of the outer legs and the area of the cross section of the central leg in the case where ferrite magnets are disposed in gap parts between the opposed outer legs, differences in direct current superposition characteristics at temperatures 25° C. and 100° C.

between a choke coil according to a third example that includes the butterfly-shaped cores 21 according to the second embodiment shown in FIG. 9A and a choke coil according to the third example that includes the butterfly-shaped cores 2 according to the first embodiment shown in FIG. 9B were determined by analysis.

The analysis was conducted for one butterfly-shaped core 21 shown in FIG. 9A that had a dimension D of 60.0 mm and two butterfly-shaped cores 2 shown in FIG. 9B that had dimensions D of 45.0 mm (two outer legs (1) in Table 2) and 50.0 mm (two outer legs (2) in Table 2). In this example, again, the gap was adjusted to achieve an equal inductance. Table 2 shows areas of various parts of the choke coil in the third example and ratios thereof.

Table 2 shows the area of the cross section of the central leg, the area of the cross section of one outer leg, the total sum of the areas of the cross sections of the outer legs and the ratio of the total sum of the areas of the cross sections of the outer legs to the area of the cross section of the central leg expressed in percentage for these three kinds of choke coils according to this example.

Figure 10A:
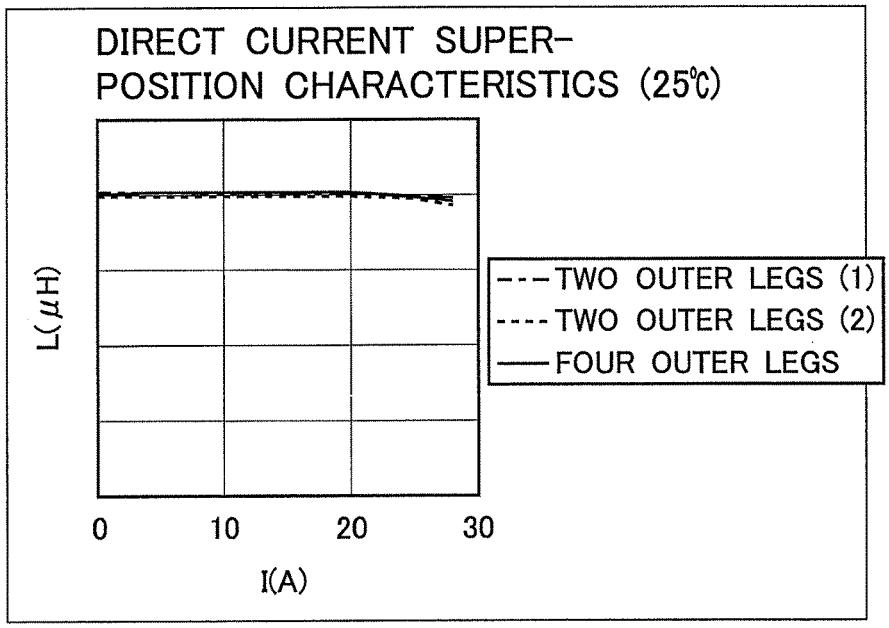
FIG. 10A is a graph showing a result of analysis of direct current superposition characteristics conducted for choke coils shown in Table 2.
Figure 10B:
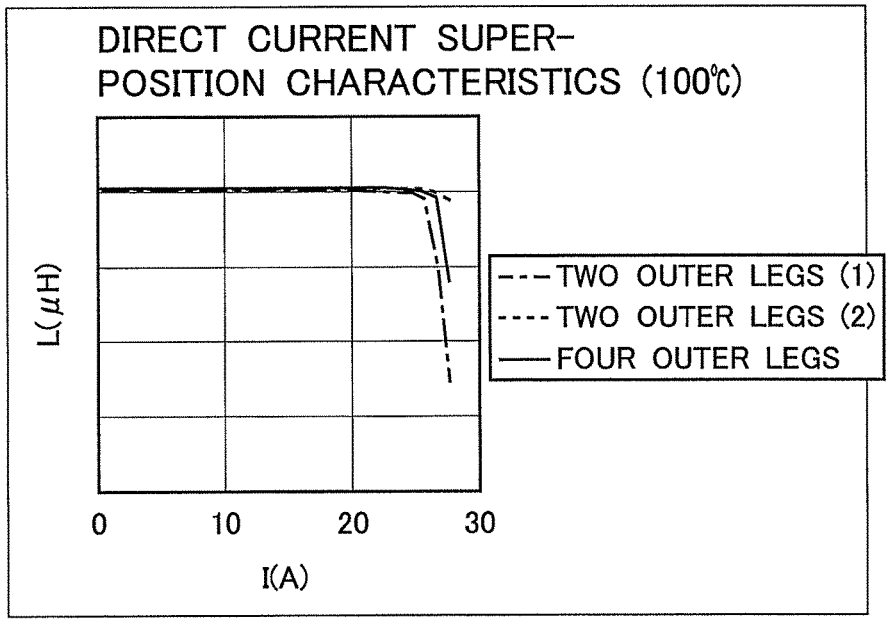
FIG. 10B is a graph showing a result of analysis of direct current superposition characteristics conducted for the choke coils shown in Table 2.

FIGS. 10A and 10B are graphs showing results of the analysis for the direct current superposition characteristics at temperatures of 25° C. and 100° C., respectively, conducted using the choke coils shown in Table 2.

TABLE 2

| NUMBER OF OUTER LEGS | AREA OF CROSS SECTION OF CENTRAL LEG | AREA OF CROSS SECTION OF ONE OUTER LEG | TOTAL SUM OF AREAS OF CROSS SECTIONS OF OUTER LEGS | (TOTAL SUM OF AREAS OF CROSS SECTIONS OF OUTER LEGS)/(AREA OF CROSS SECTION OF CENTRAL LEG) % |
|---|---|---|---|---|
| FOUR | 410 | 165 | 660 | 161 |
| TWO (1) | 410 | 243 | 486 | 119 |
| TWO (2) | 410 | 280 | 560 | 137 |

As shown in these drawings and the table, while the result of the analysis conducted at 25° C. demonstrated that any choke coil did not exhibit a significant inductance reduction even if the current exceeded 20 A, the result of the analysis conducted at 100° C. demonstrated that the coils exhibited a less significant inductance reduction at high direct currents as the area ratio described above increased, that is, as the total sum of the areas of the cross sections of the outer legs was more significantly larger than the area of the cross section of the central leg.

The present invention can provide a choke coil that can apply an optimal magnetic bias by suppressing the effect of demagnetization even if the amount of current increases and can be reduced in size, weight and cost.

REFERENCE SIGNS LIST

1, 20 ferrite core assembly
2, 21 butterfly-shaped core
4, 23 outer leg (second core part)
5, 24 central leg (first core part)
6 coil
7, 8, 11 ferrite magnet
9, 10 flat plate member
9*a*, 10*a* hole

The invention claimed is:

1. A choke coil, comprising:

a coil; and a core comprising a pair of butterfly-shaped cores positioned in an opposed relation along an axis of the coil to form a closed magnetic path, wherein each of the butterfly-shaped cores comprises:

a flat plate part positioned on an end side of the coil, second core parts standing at both ends of the flat plate part at an outer circumference of the coil, and a first core part standing at the center between the second core parts and inserted into a central part of the coil so that the second core parts and the first core part are integrally formed, the flat plate part having a gradually increasing width as it comes closer to the second core parts, wherein the second core parts are shaped so that the total sum of areas of cross sections thereof perpendicular to an axis of the coil is greater, by at least 19%, than the area of a cross section of the first core part, a gap part is formed in the second core parts, and a ferrite magnet that applies a magnetic bias is disposed in the gap part.

2. The choke coil according to claim 1, wherein the ferrite magnet is formed by a plurality of separate ferrite magnets divided in a plane perpendicular to a direction of a magnetic flux contained in the second core parts.

3. The choke coil according to claim 1, wherein a flat plate member made of a resin or ferrite having a plurality of holes penetrating from a top surface to a bottom surface thereof is provided in the gap part, and the separate ferrite magnets are inserted into the holes.

4. The choke coil according to claim 1, wherein the choke coil is to be incorporated in a power supply circuit having a capacity of 1 kw to 10 kw.

* * * * *